US007236142B2

(12) United States Patent
Amyotte et al.

(10) Patent No.: US 7,236,142 B2
(45) Date of Patent: Jun. 26, 2007

(54) ELECTROMAGNETIC BANDGAP DEVICE FOR ANTENNA STRUCTURES

(75) Inventors: Eric Amyotte, Laval (CA); Yan Brand, Ile Bizard (CA); Virgine Dupessey, Montréal (CA); Santiago Sierra-Garcia, Montréal (CA)

(73) Assignee: MacDonald, Dettwiler and Associates Corporation

( * ) Notice: Subject to any disclaimer, the term of this patent is extended or adjusted under 35 U.S.C. 154(b) by 39 days.

(21) Appl. No.: 11/240,497

(22) Filed: Oct. 3, 2005

(65) Prior Publication Data

US 2006/0082512 A1 Apr. 20, 2006

Related U.S. Application Data

(60) Provisional application No. 60/614,986, filed on Oct. 4, 2004.

(51) Int. Cl.
*H01Q 15/02* (2006.01)

(52) U.S. Cl. ..... 343/909; 343/756; 343/781 P

(58) Field of Classification Search ..... 343/700 MS, 343/754, 756, 779, 781 P, 909
See application file for complete search history.

(56) References Cited

U.S. PATENT DOCUMENTS 5,386,215 A 1/1995 Brown
5,541,614 A 7/1996 Lam et al.
6,552,696 B1 * 4/2003 Sievenpiper et al. ..... 343/909
6,603,912 B2 * 8/2003 Birks et al. ..... 385/125
6,684,008 B2 1/2004 Young et al.
6,727,863 B2 * 4/2004 Wen et al. ..... 343/909
7,071,888 B2 * 7/2006 Sievenpiper ..... 343/745
7,136,028 B2 * 11/2006 Ramprasad et al. ..... 343/909

* cited by examiner

*Primary Examiner*—Tho Phan
(74) *Attorney, Agent, or Firm*—Equinox Protection Inc.; Franz Bousnag, Patent Agent

(57) ABSTRACT

An electromagnetic bandgap device is mountable on a RF disturbing structure of an antenna to minimize signal field disturbance imparted thereby. The RF disturbing structure is oriented in a direction substantially parallel to a path of travel of an antenna signal and located within a field covered by the signal transmitted by a feed. The bandgap device comprises a plurality of RF perturbing elements connected to the RF disturbing structure and spaced apart from one another in the direction substantially parallel to the signal path. The perturbing elements are positioned, configured and sized to direct a disturbed portion of the signal away therefrom to reduce field disturbance generated by the disturbed signal portion interacting with an undisturbed portion of the antenna signal.

13 Claims, 7 Drawing Sheets

ELECTROMAGNETIC BANDGAP DEVICE FOR ANTENNA STRUCTURES

CROSS REFERENCE TO RELATED APPLICATIONS

Priority of U.S. Provisional Application No. 60/614,986, filed on Oct. 4, 2004, is hereby claimed.

FIELD OF THE INVENTION

The present invention relates to the field of antennas and is more particularly concerned with an electromagnetic bandgap device to reduce the antenna field disturbance.

BACKGROUND OF THE INVENTION

It is well known in the art to use dielectric stiffeners in the manufacturing of antennas, especially between reflector shells of dual-gridded reflectors (DGRs), to minimize the RF (radio frequency) impact of such stiffeners on the overall antenna RF performance. Although dielectric materials such as Kevlar™, glass fibers and the like are used, the stiffeners are not ideal RF transparent structural posts and result in antenna field disturbance with typical increased sidelobe degradation of the signal.

Photonic bandgaps (PBGs) have been recently developed and used in microwave based applications such as in transmission lines with enclosed or channeled fields, including closed and open wave guides and the like, in which all the RF signal gets transmitted through. PBG structures include periodically disposed electrically reflective elements and exhibit RF properties that prevent propagation of electromagnetic waves in a specific direction at pre-determined frequency bands.

Known PBG technology is not applicable to open field antennas because of the relatively large signal cross-sectional path they have at any location between the feed and the reflector of the antennas, as opposed to transmission lines.

Accordingly, there is a need for an electromagnetic bandgap antenna structural element that improves the overall antenna performance.

SUMMARY OF THE INVENTION

It is therefore a general object of the present invention to provide an electromagnetic bandgap device for antenna structures.

An advantage of the present invention is that the electromagnetic bandgap device reduces the field disturbance of the antenna signal.

Another advantage of the present invention is that the electromagnetic bandgap device redirects (or reflects) the disturbed portion of the antenna signal away, typically orthogonally, from the signal path direction to limit its impact on the undisturbed portion of the signal, and avoid further reflection thereof back into the undisturbed portion of the signal.

A further advantage of the present invention is that the electromagnetic bandgap device can be used to obviate mechanical defects and/or non-uniformity of structural members of an antenna that would disturb the field of the RF antenna signal.

According to a first aspect of the present invention, there is provided an electromagnetic bandgap device for mounting on a RF disturbing structure of an antenna to minimize signal field disturbance imparted thereby, the RF disturbing structure being oriented in a direction substantially parallel to a path of travel of an antenna signal and located within a field covered by the signal, the bandgap device comprises: a plurality of RF perturbing elements connectable to the RF disturbing structure and spaced apart from one another in the direction substantially parallel to the signal path, said plurality of perturbing elements being positioned, configured and sized to direct a disturbed portion of the signal away therefrom so as to reduce field disturbance generated by the disturbed signal portion interacting with an undisturbed portion of the antenna signal.

Typically, the RF perturbing elements are substantially periodically spaced from one another; and preferably equally spaced from one another.

Alternatively, the RF perturbing elements are un-equally spaced from one another following a predetermined trend.

In one embodiment, the RF perturbing elements direct the disturbed portion of the signal substantially away from the signal path so as to allow loss of the disturbed signal portion.

In one embodiment, the RF perturbing elements direct the disturbed portion of the signal away therefrom in a direction generally perpendicular from the signal path.

In one embodiment, the RF perturbing elements are made out of RF reflective materials; and typically metallic materials.

Typically, the RF perturbing elements are positioned around, bonded or etched on at least a portion of the RF disturbing structure.

Alternatively, the RF perturbing elements are inserts locatable inside on at least a portion of the RF disturbing structure.

In one embodiment, the RF perturbing elements are spaced from one another by a spacing substantially equals to about three quarter of an average wavelength of the signal over a predetermined frequency range.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following FIGS., in which similar references used in different FIGS. denote similar components, wherein.

DETAILED DESCRIPTION OF THE PREFERRED EMBODIMENTS

With reference to the annexed drawings, the preferred embodiments of the present invention will be herein described for indicative purpose and by no means as of limitation.

Figure 1:
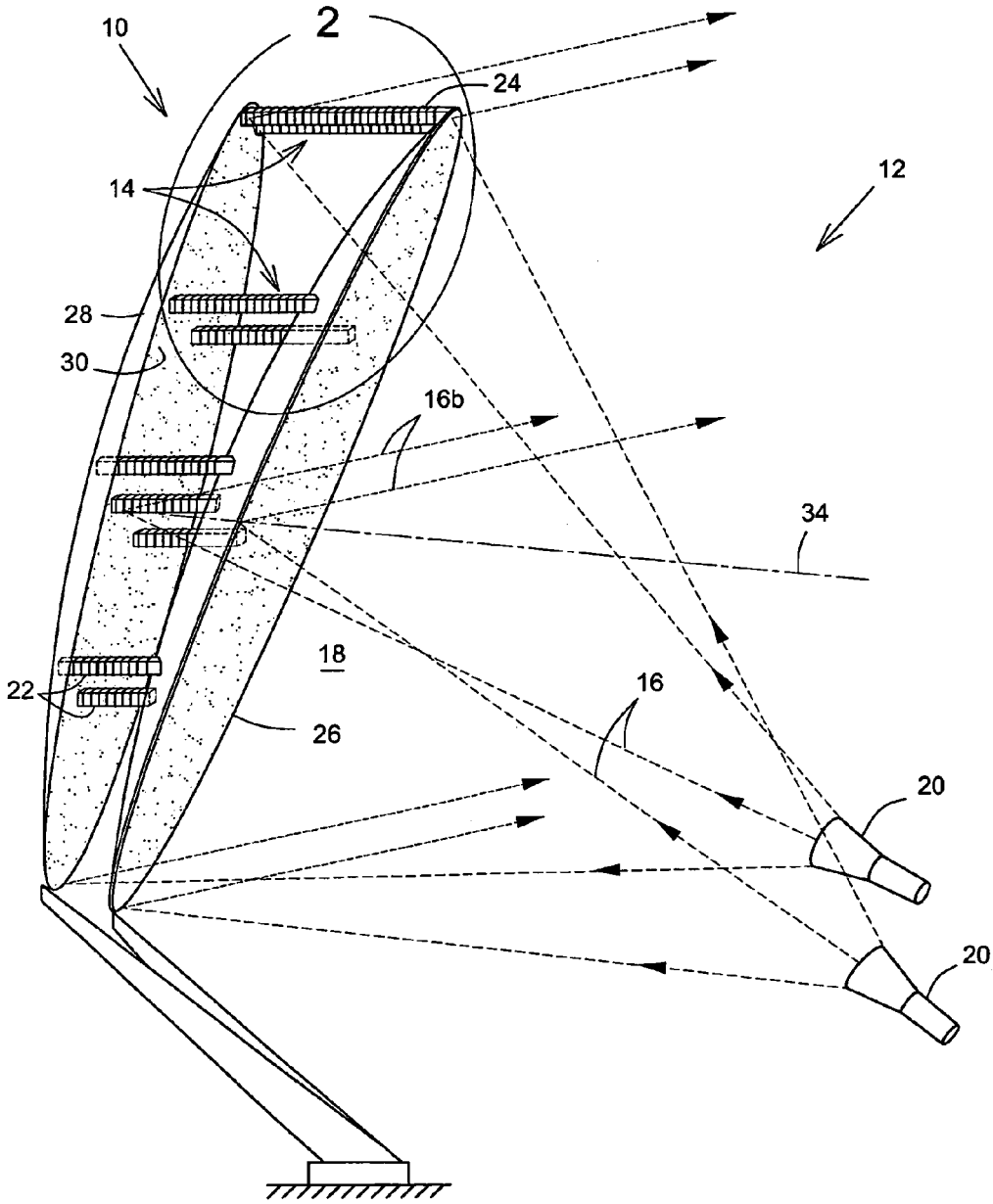
FIG. 1 is a simplified perspective view of an electromagnetic bandgap device in accordance with an embodiment of the present invention mounted on structural members of an antenna.

Referring to FIG. 1, there is schematically shown an electromagnetic bandgap device 10 in accordance with an embodiment of the present invention. The bandgap device 10 is typically connected to structural members 14 of an antenna 12 that are within or adjacent the field of view 18 of the electromagnetic signal 16 transmitted through the antenna 12 from the feed 20.

Typically, such structural members 14 are stiffeners or posts 22 and intercostals rings (or walls) or portions thereof 24 used as structural reinforcements between the two front and rear shells 26, 28 of dual-gridded reflector (DGR) assemblies. In the design of the antenna 12 shown in FIG. 1, these RF disturbing structural members 14 are located either within or adjacent to the field of view 18 of the signal reflected by the front surface 30 of the rear shell 28.

The RF disturbing structural members 14 are usually partially Radio-Frequency (RF) transparent to limit their electrical impact on the antenna performance, but the latter is not mandatory. Accordingly, they typically include RF transparent materials such as, but not limited to, Kevlar™, glass fibers and thermoplastic materials including commonly known polyester or polyethylene terephthalate (PET) (including Mylar™), polyimide (including Kapton™), fluorinated ethylene propylene (FEP) (including polytetrafluoroethylene (PTFE) Teflon™) and the like materials. The structural members 14 are typically oriented between the two shells 26, 28 in a direction 32 substantially parallel or acute to an average direction of travel 34 of the antenna signal between the incoming signal 16 and the signal 16*b* reflected by the reflector surface 30.

Figure 2:
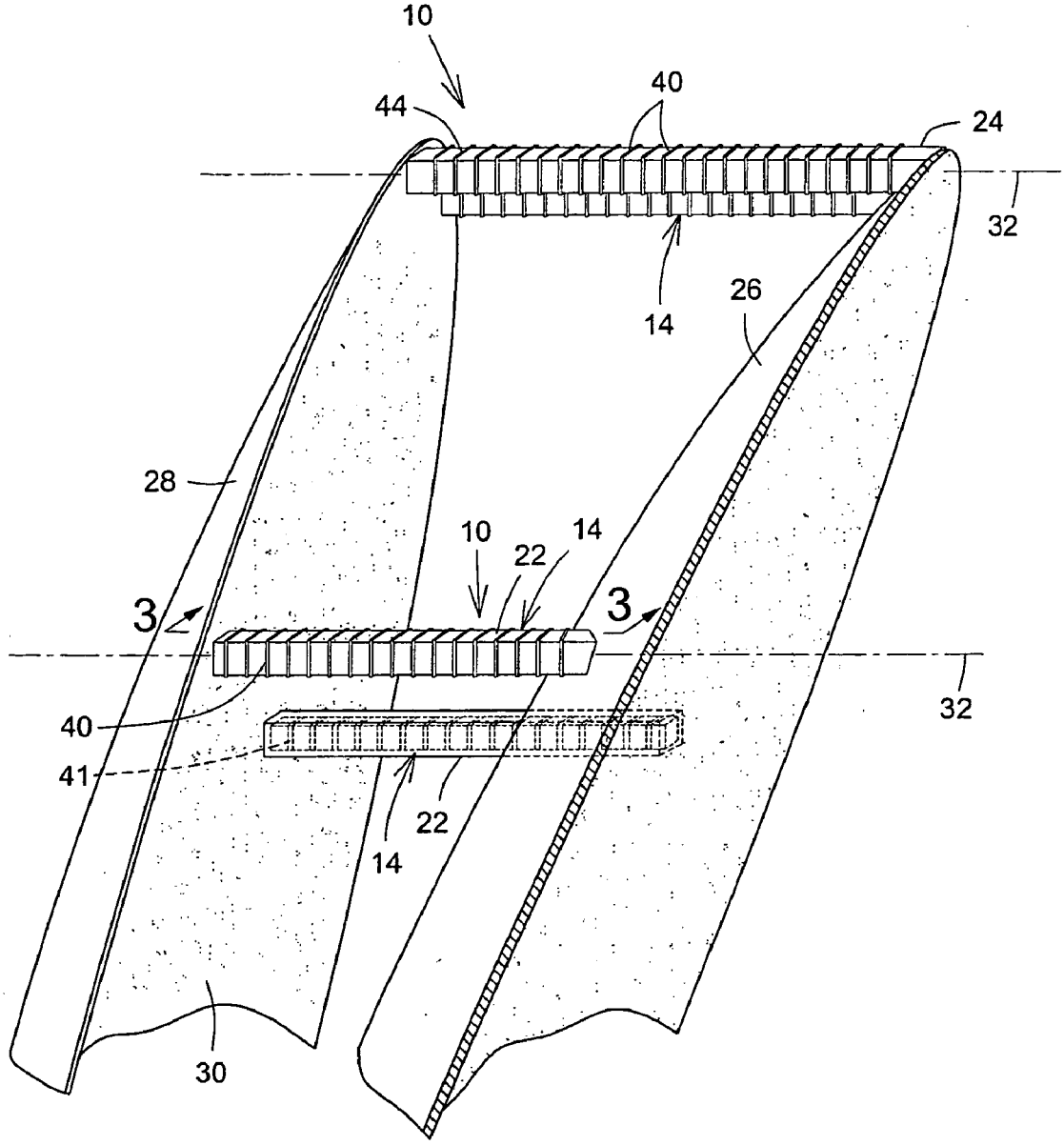
FIG. 2 is a simplified enlarged and broken view taken along line 2 of FIG. 1, showing the bandgap device on the structural members maintaining the two reflectors spaced apart from one another.
Figure 3:
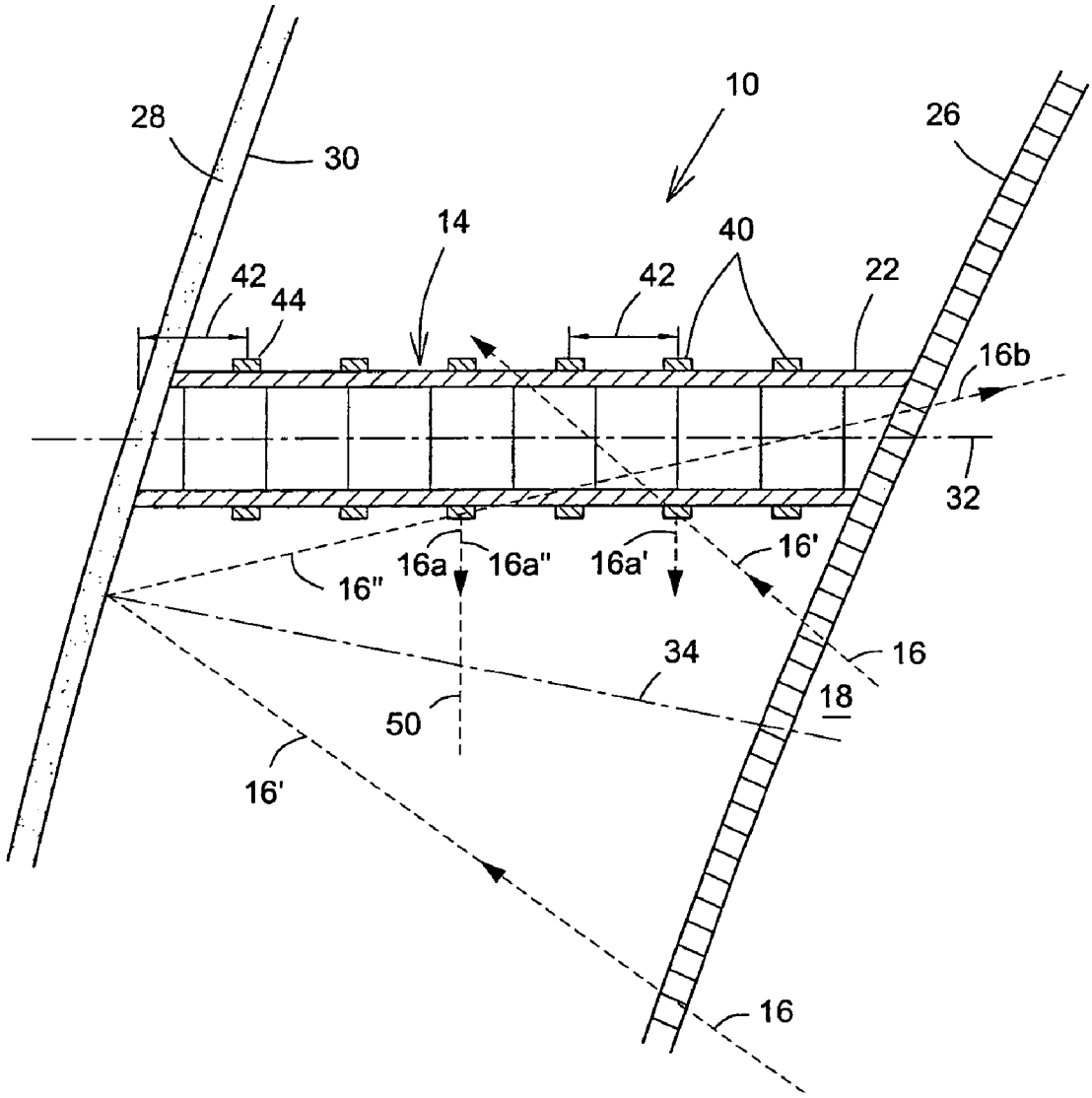
FIG. 3 is a simplified enlarged and broken section view taken along line 3–3 of FIG. 2, showing the RF perturbing elements of the bandgap device on the structural post between the two reflectors.

Referring more specifically to FIGS. 2 and 3, the electromagnetic bandgap device 10 is a plurality of (at least one) RF perturbing elements 40. The perturbing elements 40 are typically, but not limited to, metallic rings wrapped around at least a portion of, preferably all along, the structural members 14, or metallic or dielectric insert(s) 41 (shown in dotted lines) placed inside the structural members 14 and in general are made out of materials with forms or shapes that can be used to create a perturbation of the electromagnetic fields inside and/or in the vicinity of the structural members 14, or at least a portion thereof. The perturbing elements 40 are typically periodically, preferably equally, spaced from one another by a pre-determined spacing 42 in the direction 32 substantially parallel or acute to the direction 34 of the antenna incident and/or reflected signal 16, 16*b*. The closest perturbing elements 44 to the signal reflecting surface 30 is typically spaced therefrom by the same or a multiple of the pre-determined spacing 42. In some case, the perturbing elements 40 can also be selectively un-equally spaced from one another, such as following a logarithmic, an exponential or the like predetermined trend, to obtain the desired bandgap improvement over a larger frequency bandwidth and/or over a larger angular range of both incident and reflected RF signals 16, 16*b*.

Each perturbing elements 40 is typically made out of an electrically reflective material such as, but not limited to, dielectrics and metallic materials.

The pre-determined spacing 42 typically depends on the frequency range of the electromagnetic signal being transmitted by the antenna 12. Typically, the spacing 42 is a multiplier of a quarter of the wavelength ($\lambda/4$) of the signal, preferably about three quarter of the wavelength ($3\lambda/4$) and is optimized for the reasons explained further down below. As it would be obvious to one skilled in the art, the larger the spacing 42 the smaller the RF blockage of the incoming signal 16' from the feed 20 to the rear shell surface 30 due to the rings 40 is.

Since the direction of the signal 16 varies between the incoming signal 16' from the feed 20 and the reflected signal 16" away from the rear shell surface 30, the direction of the spacing 42 is typically anywhere from about the incoming direction 16' and about the reflected direction 16", and preferably about halfway there between in the average direction 34, as shown in FIG. 3 and also called the signal path. The direction of the bandgap device 10 may vary depending on the location of the structural member 14 relative to the field of view 18 of the signal 16.

OPERATION

During transmission of the antenna 12, a portion of the RF signal 16', 16" hits the bandgap device 10 or perturbing elements 40 and is directed away therefrom in a reflected direction 50. The pre-determined spacing 42 helps determining this reflected direction 50 of the disturbed portion 16*a* of the signal 16. It is therefore highly desirable that the reflected direction 50 be generally away from both the feed source 20 and the rear shell surface 30 such that the disturbed portion 16*a* of the signal 16 has a minimized impact on the undisturbed portion 16*b* of the signal 16 and on the pattern performances of the antenna 12.

Accordingly, the disturbed portion 16*a* of the signal 16, including the disturbed portion 16*a'* of the incoming signal 16' and the disturbed portion 16*a"* of the reflected signal 16", is typically reflected away from the signal path 34 or off-axis, toward a direction free of reflective surfaces (not shown) around the antenna 12, such that it is substantially entirely lost, as shown in FIGS. 2 and 3. Moreover, the spacing 42 is pre-determined and optimized to ensure the disturbed signal portion 16*a* is reflected in the desired direction, typically substantially perpendicularly from the signal path 34.

EXAMPLE

Figure 4:
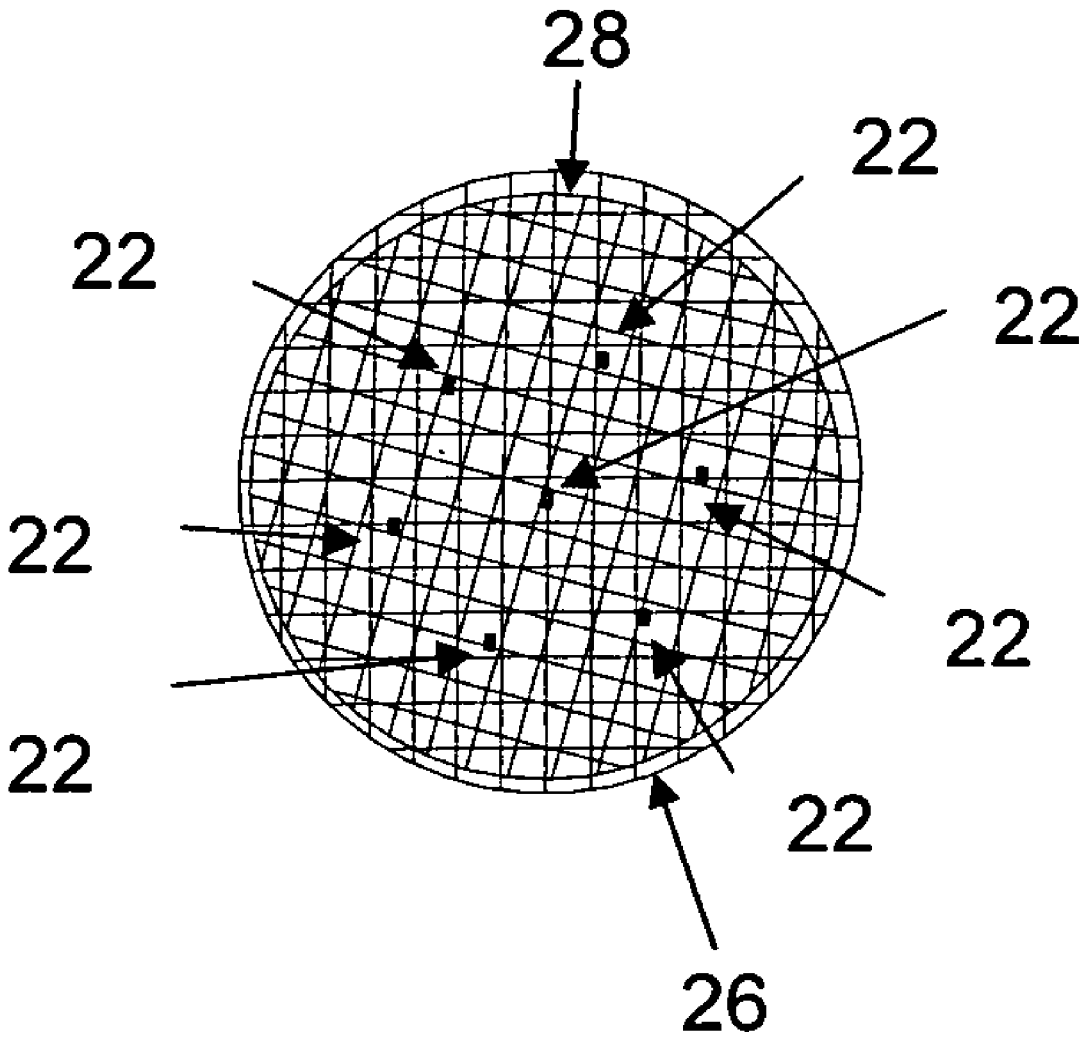
FIG. 4 is a simplified elevation view of a dual gridded reflector (DGR) used for testing, showing the location of seven stiffeners (non-illustrated inter-costal rings were also used at the periphery between the two reflectors)
Figure 5:
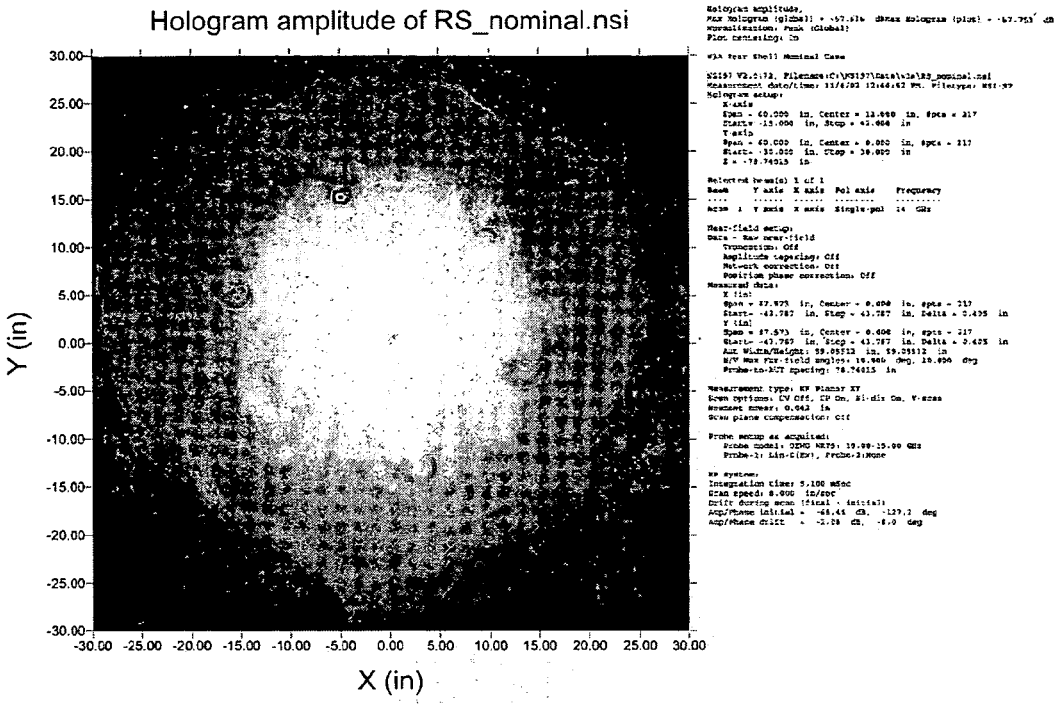
FIGS. 5 and 6 are graphical antenna test results, showing the DGR aperture magnitude of the antenna of FIG. 4 with nominal stiffeners without and with bandgap devices of the present invention respectively.
Figure 6:
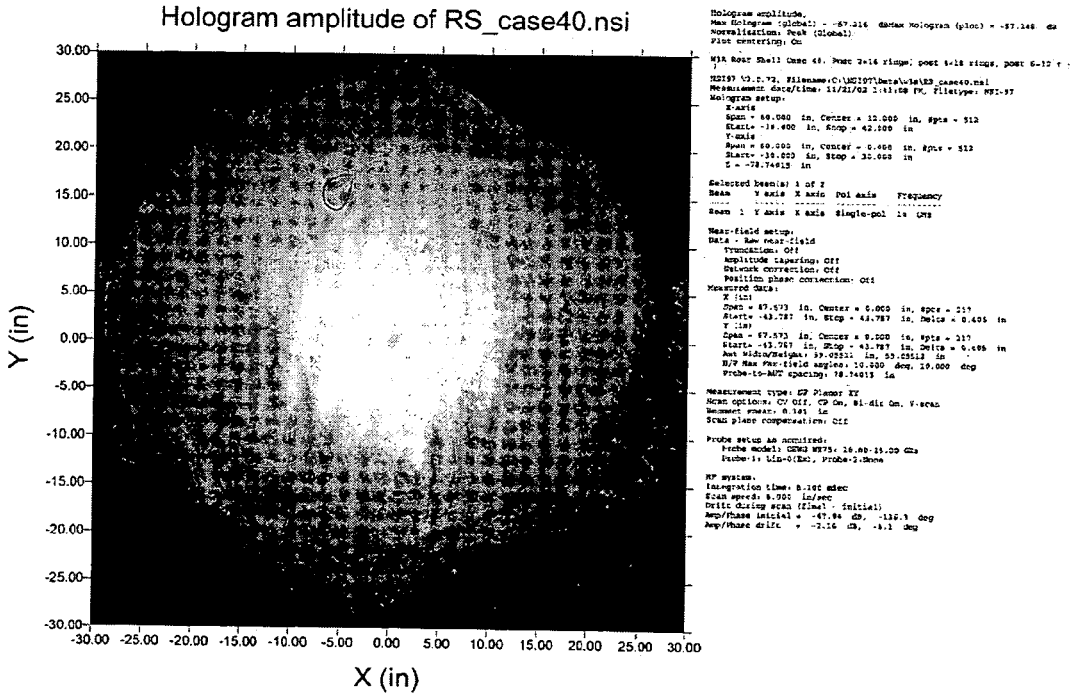
Figure 7:
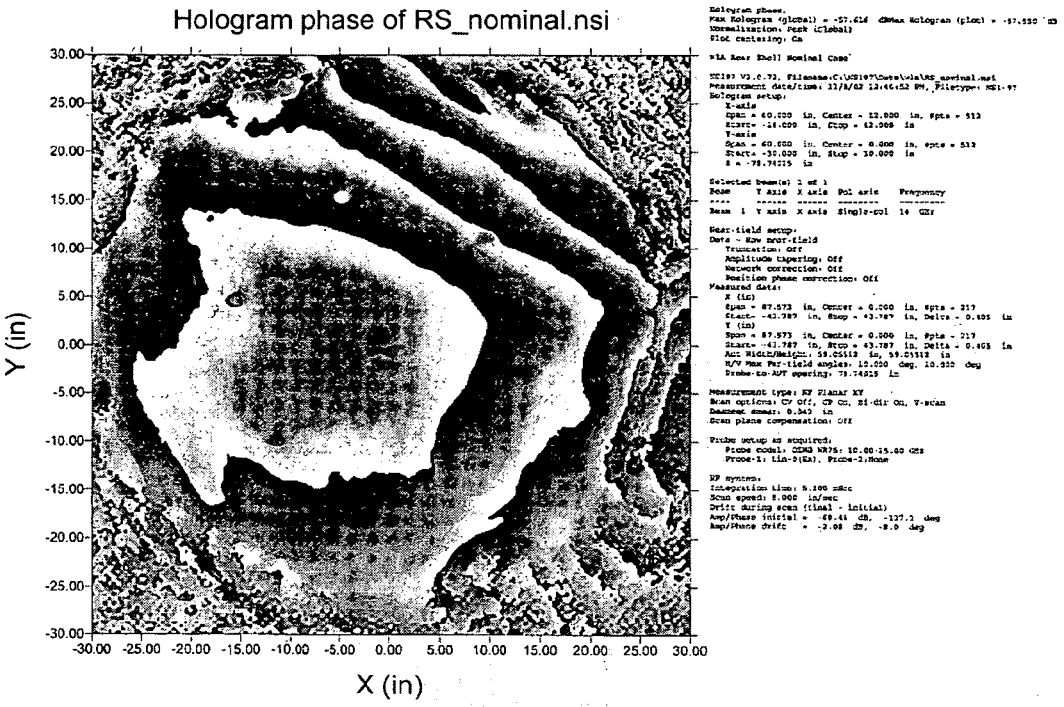
FIGS. 7 and 8 are graphical antenna test results similar to FIGS. 5 and 6 respectively, showing the DGR aperture phase of the antenna of FIG. 4 without and with bandgap devices of the present invention mounted on the stiffeners respectively.
Figure 8:
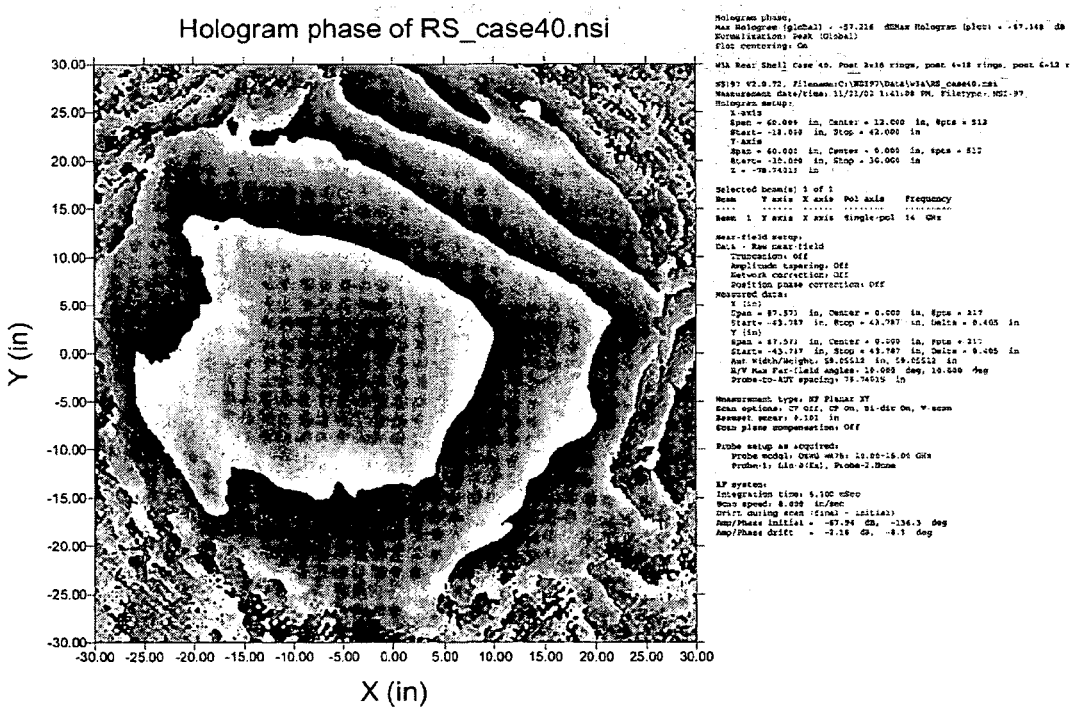

An exemplary test was performed on a DGR composed of a solid graphite back shell 28 and a polarization sensitive (i.e. gridded) kevlar front shell 26. The rear shell antenna operates at about 14.0 to 14.5 GHz. To maintain the structural integrity of the DGR, seven stiffeners 22 and intercoastal walls 24 are used as structural reinforcements between the two shells 26, 28, as shown in FIG. 4. The DGR was tested in an antenna near field test range with and without (nominal configuration) the electromagnetic bandgap device 10 of the present invention located on the seven stiffeners 22. The results of the DGR aperture planar magnitude field distribution of the antenna without and with the bandgap devices 10, shown in FIGS. 5 and 6 respectively, and of the DGR aperture planar phase distributions of the antenna without and with the bandgap devices 10, presented in FIGS. 7 and 8 respectively, clearly show that the bandgap devices 10 of the present invention significantly reduces the impact of the stiffeners 22 on the antenna performances.

Figure 9:
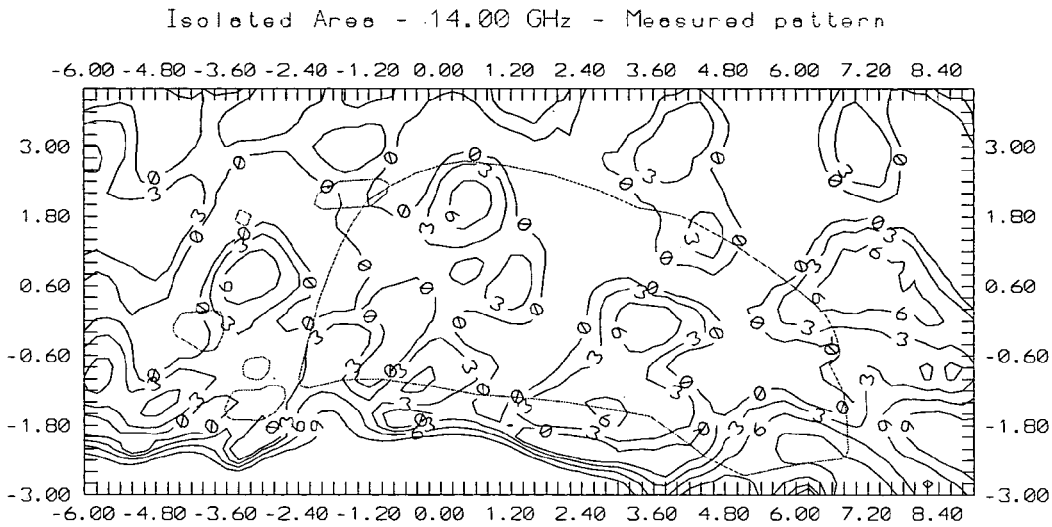
FIG. 9 is a graphical antenna test result, showing the measured side lobe performances of the rear shell of the DGR of FIG. 4 with nominal stiffeners (without the bandgap device of the present invention)
Figure 10:
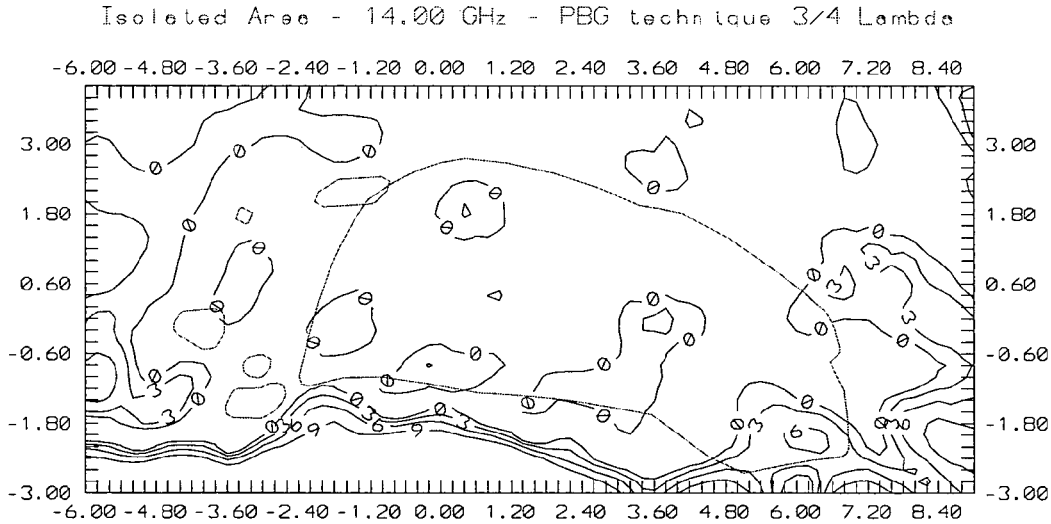
FIG. 10 is a graphical antenna test result similar to FIG. 9, showing the measured side lobe performances of the rear shell of the DGR of FIG. 4 with bandgap devices of the present invention mounted on the stiffeners.

Similarly, the antenna was tested in a compact antenna test range for the side lobe performances of the rear shell 28 at about 14.0 GHz. With the nominal stiffeners 22, the measured side lobe directivity was as high as +10 dBi inside an isolated coverage area, indicated by a dotted closed line, as shown in FIG. 9. From the same test performed with the stiffeners 22 including the bandgap devices 10 of the present invention, the measured side lobe directivity was reduced by more than 4 dB with respect to the nominal case in the isolation coverage area, indicated by a dotted closed line, as shown in FIG. 10.

Although the present electromagnetic bandgap device has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. An electromagnetic bandgap device for mounting on a RF disturbing structure of an antenna to minimize signal field disturbance imparted thereby, the RF disturbing structure being oriented in a direction substantially parallel to a path of travel of an antenna signal and located within a field covered by the signal, the bandgap device comprising:

a plurality of RF perturbing elements connectable to the RF disturbing structure and spaced apart from one another in the direction substantially parallel to the signal path, said plurality of perturbing elements being positioned, configured and sized to direct a disturbed portion of the signal away therefrom so as to reduce field disturbance generated by the disturbed signal portion interacting with an undisturbed portion of the antenna signal.

2. The bandgap device of claim 1, wherein the RF perturbing elements are substantially periodically spaced from one another.

3. The bandgap device of claim 2, wherein the RF perturbing elements are substantially equally spaced from one another.

4. The bandgap device of claim 1, wherein the RF perturbing elements are spaced from one another by a spacing substantially equals to about three quarter of an average wavelength of the signal over a predetermined frequency range.

5. The bandgap device of claim 1, wherein the RF perturbing elements are un-equally spaced from one another following a predetermined trend.

6. The bandgap device of claim 1, wherein the RF perturbing elements direct the disturbed portion of the signal substantially away from the signal path so as to allow loss of the disturbed signal portion.

7. The bandgap device of claim 6, wherein the RF perturbing elements direct the disturbed portion of the signal away therefrom in a direction generally perpendicular from the signal path.

8. The bandgap device of claim 1, wherein the RF perturbing elements are made out of RF reflective materials.

9. The bandgap device of claim 8, wherein the RF perturbing elements are made out of metallic material.

10. The bandgap device of claim 1, wherein the RF perturbing elements are bonded on at least a portion of the RF disturbing structure.

11. The bandgap device of claim 1, wherein the RF perturbing elements are etched on at least a portion of the RF disturbing structure.

12. The bandgap device of claim 1, wherein the RF perturbing elements are positioned around at least a portion of the RF disturbing structure.

13. The bandgap device of claim 1, wherein the RF perturbing elements are inserts locatable inside on at least a portion of the RF disturbing structure.

* * * * *